US005102513A

United States Patent [19]

Pelkus

[11] Patent Number: 5,102,513

[45] Date of Patent: Apr. 7, 1992

[54] APPARATUS AND METHOD FOR RECOVERING METALS FROM SOLUTIONS

[75] Inventor: Adrian Pelkus, San Marcos, Calif.

[73] Assignees: Guy Fournier; Eileen Fournier, both of Vista, Calif.

[21] Appl. No.: 612,128

[22] Filed: Nov. 9, 1990

[51] Int. Cl.[5] ..... C25C 1/00; C25C 7/00; C25C 7/06

[52] U.S. Cl. ..... 204/105 R; 204/109; 204/228

[58] Field of Search ..... 204/228, 109, 105 R

[56] References Cited

U.S. PATENT DOCUMENTS

| | | | |
|---|---|---|---|
| 3,616,412 | 10/1971 | Gnage | 204/195 |
| 3,751,355 | 8/1973 | Mandroian | 204/228 |
| 3,875,032 | 4/1975 | Thompson | 204/109 |
| 3,925,184 | 12/1975 | Cave | 204/229 |
| 4,018,658 | 4/1977 | Alfin et al. | 204/109 |
| 4,127,465 | 11/1978 | Higgins | 204/228 |
| 4,280,884 | 7/1981 | Babb et al. | 204/109 |
| 4,612,102 | 9/1986 | Brimo et al. | 204/228 |
| 4,619,749 | 10/1986 | Nusbaum | 204/228 |
| 4,776,931 | 10/1988 | Hardy | 204/105 |
| 4,800,005 | 1/1989 | Rosenfield et al. | 204/228 X |
| 4,834,849 | 5/1989 | Woog | 204/228 X |
| 5,007,993 | 4/1991 | Hull et al. | 204/228 |

*Primary Examiner*—Donald R. Valentine
*Attorney, Agent, or Firm*—Brown, Martin Haller & McClain

[57] ABSTRACT

The improved power supply is controlled by a microprocessor which operates with instructions stored in software in a programmable read only memory within the unit. As the microprocessor operates, it constantly reads the conditions of the actual voltage, actual current, preset voltage and preset current at the electrodes of the plating system. The microprocessor makes adjustments to maintain the voltage at a preset level by outputting a digital signal to a digital-to-analog converter which changes the digital command into a voltage which is used to adjust an output transistor which controls the voltage to the electrodes. The microprocessor monitors the current draw and displays the current and voltage readings on a digital display. Signals received by the microprocessor are used in a virtually continuous comparison to preset current and voltage settings which are adjustable by variable resistors, and which determine a point at which insufficient metal is contained within the solution to continue the plating operation at which time a lockout condition is triggered. During lockout, no voltage is applied to the electrodes except when sampling is to occur. Frequency of sampling during lockout is determined by the microprocessor's reset function. The microprocessor will attempt to reset by switching on the plating voltage and monitoring the current drawn to determine if sufficient current is present to continue plating. If insufficient current is detected, the lockout condition will continue with the microprocessor resetting after another clock cycle.

14 Claims, 2 Drawing Sheets

APPARATUS AND METHOD FOR RECOVERING METALS FROM SOLUTIONS

FIELD OF THE INVENTION

The present invention relates to recovery of metals from solutions, and more specifically relates to an apparatus and method for the electrolytic recovery of metals from solutions such as photographic processing baths.

BACKGROUND OF THE INVENTION

The process of electrolytic removal of metals from solutions involves immersing a pair of electrodes in an electrolytic solution containing the metal to be recovered and inducing a voltage across the electrodes, that voltage having sufficient magnitude to cause electrolytic deposition of the desired product.

This process has been used in the recovery of silver from used photographic processing solutions. In the processing of exposed photographic films or papers, various silver salts employed in their manufacture are dissolved in the aqueous fixative or stop solutions as complex silver salts. If the silver content of these processing solutions is allowed to rise above a certain value, their chemical action becomes unsatisfactory, and the solution must be replaced. By removing silver from the solutions during processing, the life of the solutions can be greatly extended thereby reducing the cost of the process. In addition, the reclaimed silver can be used as a source of revenue. Finally, the Environmental Protection Agency (EPA) has provided increasingly strict guidelines for the amount of metals which may remain in a solution at the time of disposal, creating a need for highly efficient removal of silver from solution.

Prior art electrolytic methods for recovering silver from film processing solutions possess a number of drawbacks. One of the drawbacks is contamination of the processing solution. Another is the release of noxious gases, as a result of the decomposition of sulphur ions which consequently may produce hydrogen sulphide gas. The release of hydrogen sulphide gas is a result of attack of the plated silver by the sulphide ions.

Prior systems which have attempted solutions to the above problems include U.S. Pat. No. 3,875,032 issued to Thompson, which shows a system for measuring the concentration of silver in solution using dedicated measuring electrodes which are excited to a fixed voltage. The current is used to control the current applied to the primary plating electrodes. U.S. Pat. No. 3,616,412 issued to Gnage discloses a system for measuring silver concentration by determining the time required for the resistance between two cathodes in the solution to drop below a predetermined value. This value is used to control plating current flow. Both of these systems result in some contamination of the solution and in the release of hydrogen sulphide gas due to the occasional use of high plating voltages.

U.S. Pat. No. 4,612,102 issued to Brimo discloses an electroplating power supply which uses two current set points, one high and one low. When the current at the electrodes exceeds the high set point it is an indication that there is enough silver in solution for electroplating to occur. As plating continues and silver is removed from solution, the current drops, causing the applied voltage to drop when the current falls below the low set point. The circuit continues to monitor current and when the current rises above the low set point, the circuit returns to high voltage to continue plating. The plating process continues until the amperage drops again below the high set point and the control recycles as before. No plating occurs from the time the amperage drops below the high set point and the time the amperage rises above the low set point. During this interval, metal can build up in solution because photographic processes continuously add and remove solution. As a result, valuable silver can be lost, and the removed solution may contain more than the minimum amount of metal permitted for disposal without extra precautions.

The apparatus described in U.S. Pat. No. 4,776,931 of Hardy overcomes some of the sensitivity problems by intermittently sampling the metal content of the solution by applying the plating voltage to the electrodes to determine if the current drawn by the solution exceeds a preset value indicating sufficient metal in solution for plating. When the current drawn by the solution falls below a threshold value, a lower standby voltage is applied, that standby voltage being greater than zero, with the higher plating voltage intermittently applied to determine if sufficient metal has been added to the solution to resume plating. The Hardy system samples at approximately four second increments both during plating and in standby. A certain amount of inaccuracy is involved in this sampling because the analog technology provides a relatively slow response time which, particularly during application of the plating voltage, could result in a sufficient delay to cause damage to the electrodes and/or plated metal before the plating voltage is switched off. Another disadvantage of the Hardy system is that it requires the use of two separate voltage regulators, one for negative output voltage and the other for positive output voltage, which can lead to difficulty in calibration and troubleshooting of the equipment.

It is known, particularly for switching circuits, that digital technology provides quicker response than analog technology. It is therefore desirable to provide quick switching and response capability of digital technology to an intermittent sampling apparatus in an electroplating power supply to provide rapid, accurate switching and adjustment to compensate for changes in the metal content of the solution. It is also desirable to provide an electroplating system which is extremely efficient in its removal of metals from solution such that the treated solution meets the increasingly stringent requirements for disposal as defined by the Environment Protection Agency. It is to such an apparatus and method that the present invention is directed.

SUMMARY OF THE INVENTION

It is an advantage of the present invention to provide a power supply for electroplating systems which utilizes digital technology for rapid sampling and response, for driving of displays, and for providing a smooth output waveform to apply a constant plating voltage when the plating voltage is desired.

It is a further object of the present invention to provide a power supply for electroplating which utilizes a single voltage regulator for logic and reference in order to simplify calibration and troubleshooting of the equipment.

In an exemplary embodiment, the improved power supply of the present invention is controlled by a microprocessor which operates with instructions stored in software in a programmable read only memory within the unit.

As the microprocessor operates, it constantly reads the conditions of the actual voltage, actual current, preset voltage and preset current at the electrodes of the plating system. The above four parameters are fed one-at-a-time in a continuous stream by a switch to an analog-to-digital converter which translates the analog voltage received from the switch into digital data for input into the microprocessor.

After each sample is digitized and read, the microprocessor makes adjustments to maintain the voltage at a preset level by outputting a digital signal to a digital-to-analog converter which changes the digital command into a voltage which is used to adjust an output transistor which controls the voltage to the electrodes.

In addition to maintaining voltage, the microprocessor monitors the current draw and displays the current and voltage readings on a digital display. The display is capable of indicating both voltage and current.

Signals received by the microprocessor are used in a virtually continuous comparison to preset current and voltage settings which are adjustable by variable resistors, and which determine a point at which insufficient metal is contained within the solution to continue the plating operation at which time a lockout condition is triggered, turning off the plating voltage. During lockout, no voltage is applied to the electrodes except when sampling is to occur. The frequency of sampling during lockout is determined by the microprocessor's reset function. Depending on the clocking cycle of the microprocessor, the microprocessor will attempt to reset by switching on the plating voltage and monitoring the current drawn to determine if sufficient current is present to continue plating. If insufficient current is detected, the lockout condition will continue with the microprocessor resetting after another clock cycle, again attempting to actuate the plating voltage.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF A PREFERRED EMBODIMENT

Figure 1:
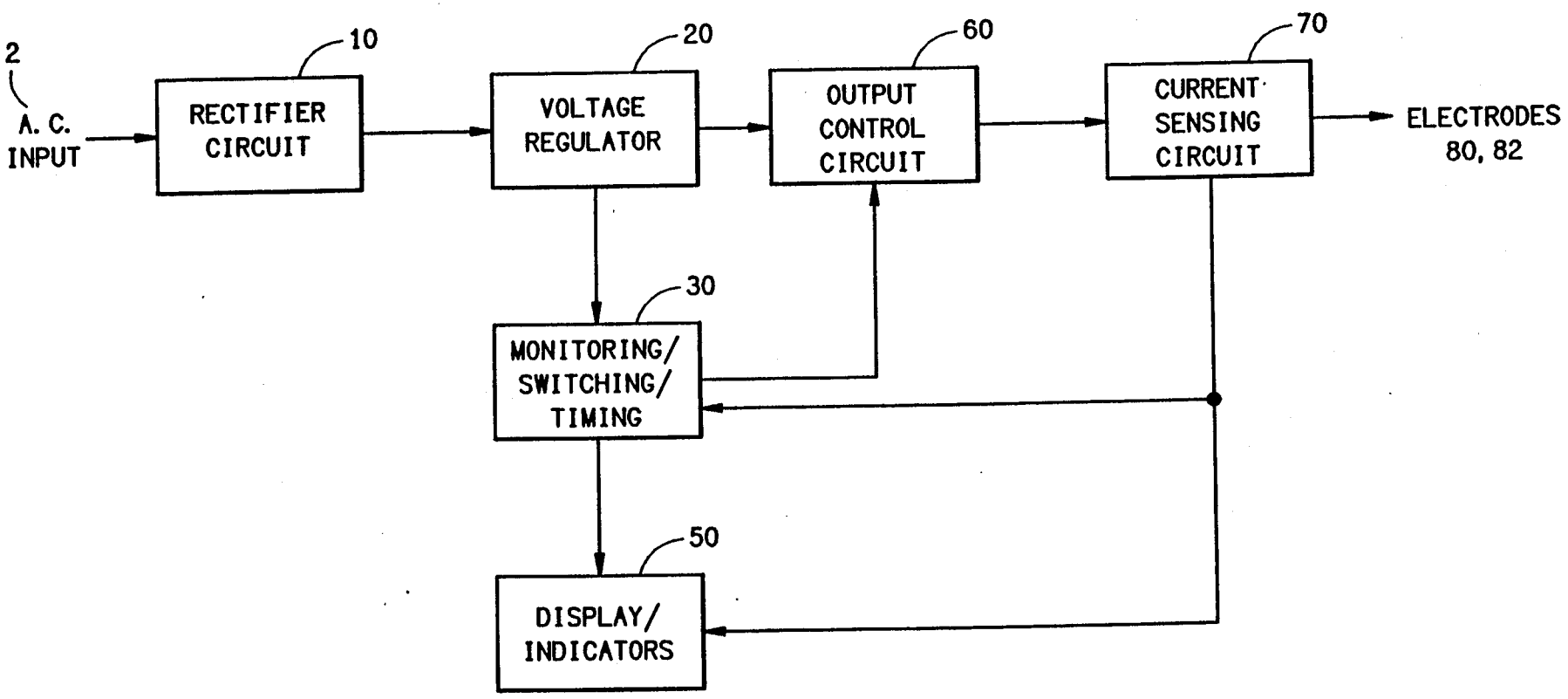
FIG. 1 is a schematic electric circuit block diagram of the power supply of the present invention.
Figure 2:
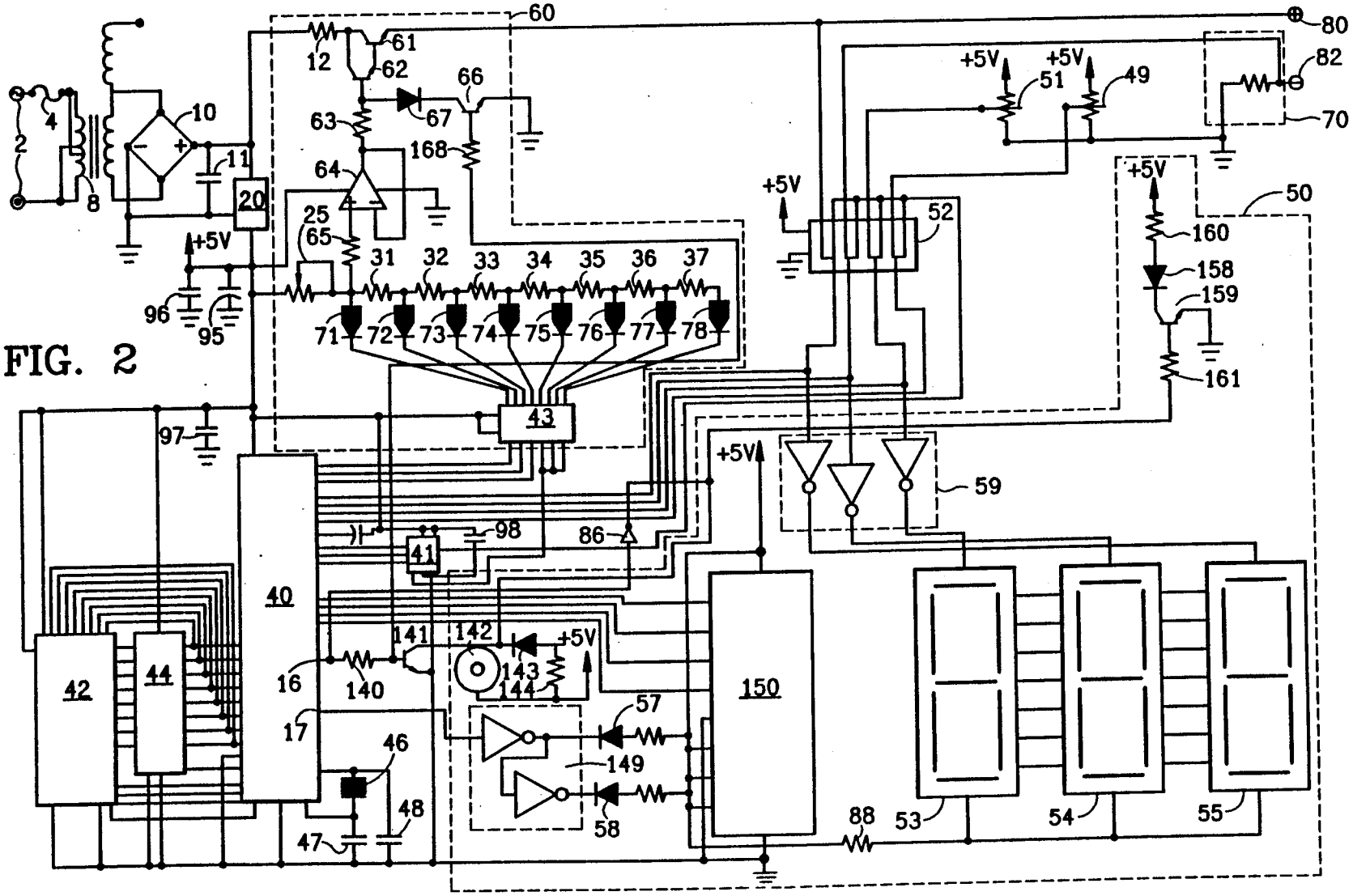
FIG. 2 is a schematic electric circuit diagram of the present invention.

As shown in FIGS. 1 and 2, the preferred embodiment of the power supply of the present invention includes an AC input 2, a rectifier circuit 10, a voltage regulator 20, a monitoring/switching/timing circuit 30 including a microcontroller 40, a display circuit 50, an output control circuit 60, a current sensing circuit 70 and a pair of electrodes, cathode 80 and anode 82. The combination of the current sensing circuit 70 and microcontroller 40 provides a sampling and switching capability for detecting whether there is sufficient metal in a solution to plate out the metal onto the cathode 80. The presence of sufficient metal in solution is indicated by the current drawn across the solution between cathode 80, and anode 82. The sampling voltage is lower than the plating voltage to provide sensitivity at a voltage greater than a standby condition yet with less risk of damage to the electrodes or to the already-plated metal if the amount of metal in solution is insufficient for plating when the full plating voltage is applied.

If no current is read across the electrodes 80 and 82, the microcontroller 40 triggers a "lockout" condition which switches off the output control circuit 60 and cuts off voltage supplied to cathode 80. Also during lockout, the microcontroller 40 triggers activation of visual and audio indicators within display circuit 50 to indicate lockout. The programming of the microcontroller 40 causes it to attempt to reset after a given clock cycle, switching on output control circuit 60 which provides the sampling voltage to cathode 80. If no current is detected between the electrodes 80 and 82 a lockout condition is again triggered by the microcontroller 40 and the voltage remains off until the next reset.

When a current is read across the electrodes 80 and 82, the voltage applied to cathode 80 is increased to the plating voltage which is varied according to the substantially continuous sampling of the current drawn by the solution. The plating voltage continues to be supplied until a measurement indicates insufficient metal in solution to draw a current exceeding a preset threshold, at which time lockout occurs.

Referring to FIG. 2, which shows a detailed embodiment of the power supply, a microprocessor 40 is adapted to control the output voltage, display of output voltage and current, and regulation functions of the power supply. Microprocessor 40 operates in accordance with software instructions stored in an erasable programmable read-only memory (EPROM) 42. Software instructions are retrieved and stored in a temporary memory latch 44 from which they are passed to microprocessor 40 in a manner well-known in the art. Microprocessor 40 operates at a 3.579 MHz clock rate, which is established by a clock circuit comprising a crystal 46, and the two capacitors 47 and 48.

Microprocessor 40, operating under stored program control, monitors the four circuit parameters comprising actual output voltage, actual output current, preset reference voltage, and preset reference current. The preset reference voltage is established by adjusting variable resistor 49 while monitoring the appropriate test point. The preset reference current is established by adjusting resistor 51 while monitoring the appropriate test point (not shown). These four parameters are continuously and sequentially sampled by a quad switch 52. Switch SW1 is a double pole double throw momentary switch which permits the operator to substitute preset reference voltage and current for actual output voltage and current into quad switch 52. When SW1 is in its momentary position, the preset reference voltage is provided to the first and third inputs to quad switch 52 and the preset reference current is provided to the second and fourth inputs to quad switch 52. Microprocessor 40 causes quad switch 52 to sequentially step through the four measurements by means of four control lines from microprocessor 40 to quad switch 52.

Thus, microprocessor 40 raises the first sample line while holding the other three sample lines down. Quad switch 52 then connects the selected analog variable of the input to an analog-to-digital (A/D) converter 41. A/D converter 41 then converts the selected analog variable to a single word, comprising eight bits, which is then passed to microprocessor 40. After the analog sample has settled and the output of A/D converter 41 has stabilized, microprocessor 40 then drops the first sample line and raises the second sample line. This causes quad switch 52 to connect the next analog variable to A/D converter 41. This process continues sequentially through the four analog variables and then restarts. The sampling of each parameter is substantially continuous in that any delay between subsequent readings of the same parameter is only the switching time to step through the other three parameters.

After each analog variable is sampled and read, microprocessor 40 makes adjustments to the output voltage as necessary to keep it equal to the preset reference voltage by computing an error level and passing a three-bit byte error value to a digital-to-analog (D/A) converter 43. D/A converter 43 converts the three-bit error value into an analog error signal by selectably connecting the eight individual resistors 31 through 37 to ground through individual diodes 71 through 78 as shown. The sensitivity of this error signal is established by adjusting resistor 25 while monitoring the analog error signal voltage on an appropriate test point (not shown).

This analog error signal is passed to operational amplifier 64, which serves to isolate the output voltage control circuit from the digital-to-analog conversion circuit. The output from op amp 64 is passed through series resistor 63 to the base of a Darlington transistor-pair, comprising driver transistor 62 and output transistor 61, whereby output transistor 61 is biased to correct the error in the actual output voltage. The Darlington transistor-pair 62 and 61 acts as a series voltage regulator in the manner well-known in the art.

Microprocessor 40 also monitors the actual output current and displays both the output current and output voltage using a three-digit digital display comprising a display driver 150 and three seven-segment display chips 53 through 55. Microprocessor 40 first converts the actual output voltage to a series of four-bit words corresponding to the three decimal display digits and passes these four-bit words in sequence to display driver 150. Three of the four control lines between microprocessor 40 and quad switch 52 discussed above are used to multiplex the three seven-segment display chips 53 through 55. A fifth control line from microprocessor 40 selects one of two LED diode indicators 57 and 58. This multiplexing and indicator selection process requires a plurality of inverters which are provided by a multiple inverter chip 149. (The inverters are indicated by reference numerals 59 and 149 due to their location in the schematic. All inverters may physically be on the same chip.)

The multiplex control signals to display chips 53 through 55 are passed through three inverters contained in chips 59 and 149. Two more inverters from chip 149 are configured so that diode 57 is illuminated when a selection signal from pin 17 of microprocessor 40 is low and diode 58 is illuminated when the pin 17 selection signal is high. This pin 17 selection signal alternates every four seconds and is synchronized with the alternation of output voltage and output current data on the four-bit data bus from microprocessor 40 to display driver 150.

The digital data at display driver 150 is decoded and sent to display chips 53, 54 and 55. The three multiplex lines from microprocessor 40 step across display chips 53 through 55 every few milliseconds in synchronization with the shifting of display digit data from microprocessor 40. Thus, within the four-second period for the display of a single parameter, microprocessor 40, rapidly switches from the most significant digit (MSD) through the middle digit to the least significant digit (LSD) of the three-digit display. The multiplexing lines are synchronized with this shift in data in a well-known manner such that the three-digit display is driven by a single display driver (150) in a flicker-free display. At the end of the first four-second period, the control line at pin 17 of microprocessor 40 logically shifts and the same process occurs for the other display variable. The result of this circuit is a four-second display of actual output voltage accompanied with a lighted indicator 58, following by a four-second display of actual output current accompanied by a lighted LED indicator 57. This process continues indefinitely.

When the plating operation is active, a LED 158 is illuminated by means of a driver circuit comprising transistor 159 and resistors 160 and 161. When the power supply is not able to raise actual output levels to match the preset parameters for voltage and current, a lockout circuit comprising transistor 66 and diode 67 is engaged. This lockout circuit forces the voltage at the base of the Darlington pair 61 and 62 to within two diode voltage drops of ground, thereby effectively interrupting the output of the power supply.

The lockout condition is initiated by microprocessor 40 when it raises the voltage on pin 16 in response to software interpretation of actual output voltage and current values. A voltage on pin 16 turns on transistor 141 through base resistor 140 and transistor 66 through base resistor 168. Turning on 141 activates a piezoelectric sonic alarm 142 and illuminates lockout indicator diode 143 through resistor 144. The voltage on pin 16 is inverted by inverter 86 and applied to the base of transistor 159, which turns transistor 159 off. The conduction of transistor 66 forces the voltage at the base of transistor 62 down to a low value, which effectively turns off output transistor 61. With the output transistor 61 turned off, no output current exists at the power supply output electrodes 80 and 82. Microprocessor 40, under stored program control, attempts to reset the lockout condition by reactivating the power supply circuit after four seconds and remeasuring the output voltage and current conditions.

The logical components described above receive their +5 volts DC power from a five-volt regulator chip 20. A fuse 4 is provided in the primary AC side of center-tapped transformer 8 to protect the transformer from short-circuit currents. Transformer 8, with the center-tapped primary and secondary windings connected as shown, and full wave rectifier bridge 10, together with smoothing capacitor 11, provide an unregulated DC supply voltage of 25 volts. Series resistor 12 and output transistor 61 control the current flowing at the output in accordance with the control signals developed in the remainder of the circuitry as described above. Capacitors 95, 96, 97 and 98 provide local filtering of noise pulses on the 5 volt DC supply in a well-known manner.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A power supply for the application of variable voltage to a pair of electrodes in contact with a solution comprising:

a transformer having an input for connection to a source of AC power and having an output;

a rectifier circuit having an input connected to said transformer output and having an output;

a voltage regulator circuit having an input coupled to said rectifier circuit output and a first and a second output, said first output coupled to one of said electrodes for alternately providing a plating voltage and a sampling voltage, said sampling voltage and said plating voltage being unequal; and a monitoring circuit comprising a microprocessor, a memory means, switching means and a timing means, said monitoring circuit having a first input connected to said second output of said voltage regulator, and a second input for receiving electrical signals from a second of said electrodes, said monitoring circuit having a means for periodically sampling to determine whether a current is drawn across said pair of electrodes by said solution upon application of one of said sampling voltage or said plating voltage to said one of said electrodes and having means for monitoring at least two of a plurality of parameters generated from said electrical signals into digital input signals readable by said microprocessor and means for converting digital output signals generated by said microprocessor into an analog output signal for controlling said variable voltage.

2. A power supply as in claim 1 wherein said monitoring circuit includes means for substantially continuously measuring said current and comparing said current to a predetermined current threshold during application of said plating voltage.

3. A power supply as in claim 1 wherein said monitoring circuit further comprises means for interrupting the coupling of said first output to said one of said electrodes responsive to said periodically sampling means in an absence of said current, such that a lockout condition is initiated.

4. A power supply as in claim 3 wherein said interrupting means is further responsive to said substantially continuous measuring means when said current is less than said predetermined current threshold such that said lockout condition is initiated.

5. A power supply as in claim 3 wherein, in said lockout condition, said periodically sampling means applies said sampling voltage to said one of said electrodes responsive to a timing means in said monitoring circuit so that said sampling voltage is periodically applied until said lockout condition is overcome.

6. A power supply as in claim 1 wherein said monitoring circuit comprises means for monitoring at least two of a plurality of parameters comprising current, said variable voltage, said predetermined current threshold and a predetermined voltage threshold sequentially in a continuous stream.

7. A power supply as in claim 1 wherein said sampling voltage is less than said plating voltage.

8. A power supply as in claim 1 wherein said monitoring circuit further comprises a display circuit for indicating said at least two parameters.

9. A power supply as in claim 1 wherein said analog output signal is responsive to said substantially continuous measuring means such that adjustments in said analog output signal occur at the same frequency as measuring by said substantially continuous measuring means.

10. A method for recovering metal from a solution by application of a variable voltage to a pair of electrodes in contact with said solution, said method which comprises:

storing at least one preset value in a memory means, said preset value comprising a threshold for plating;

converting input from an AC power source into a rectified signal;

producing a regulated DC voltage by feeding said rectified signal into a voltage regulator;

alternately providing one of a plurality of voltage signals to one electrode of said pair from said voltage regulator;

driving a monitoring circuit with said regulated DC voltage;

periodically testing whether a current is drawn between said pair of electrodes across said solution;

generating a plurality of parameters representative of said solution from said current;

converting said plurality of parameters into digital signals;

comparing said digital signals with said preset value to generate an output digital signal;

converting said output digital signal into an analog signal for controlling an interruption means; and interrupting said one voltage signal when said current fails to exceed said preset value.

11. A method as in claim 10 wherein the step of driving a monitoring circuit further comprises substantially continuously measuring said current and comparing said current to a predetermined current threshold during application of said one voltage signal when said one voltage signal is a plating voltage.

12. A method as in claim 10 wherein the step of interrupting said one voltage signal initiates a lockout condition.

13. A method as in claim 12 wherein the step of interrupting said one voltage signal initiates a periodic sampling sequence of applying said one voltage signal when said one voltage signal is a sampling voltage until said current exceeds said preset value.

14. A method as in claim 13 wherein the step of interrupting further comprises resuming application of said plating voltage when said current exceeds said preset value.

* * * * *